United States Patent [19]

Take

[11] Patent Number: 4,949,882

[45] Date of Patent: Aug. 21, 1990

[54] POURING SPOUT FOR A LIQUID CONTAINER

[75] Inventor: Yoshiaki Take, Tokyo, Japan

[73] Assignee: Toppan Printing Company, Ltd., Japan

[21] Appl. No.: 481,657

[22] Filed: Feb. 14, 1990

Related U.S. Application Data

[63] Continuation of Ser. No. 249,318, Sep. 26, 1988, abandoned.

[30] Foreign Application Priority Data

Sep. 29, 1987 [JP] Japan ..... 62-148892[U]
Aug. 22, 1988 [JP] Japan ..... 63-109934[U]

[51] Int. Cl.[5] ..... B67D 5/00

[52] U.S. Cl. ..... 222/528; 222/541; 220/258; 229/123.3

[58] Field of Search ..... 222/81, 83, 89, 528, 222/530–532, 541, 556, 566, 526–527; 220/258–260, 334; 229/123.3, 125, 125.08

[56] References Cited

U.S. PATENT DOCUMENTS

| | | | |
|---|---|---|---|
| 2,601,399 | 6/1952 | Jones | 222/532 X |
| 2,820,581 | 1/1958 | Makuta | 222/528 |
| 3,990,603 | 11/1976 | Brochmann | 220/260 |
| 4,372,460 | 2/1983 | Brochmann et al. | 220/258 |
| 4,483,464 | 11/1984 | Nomura | 222/83 |
| 4,705,197 | 11/1987 | Gordon et al. | 206/604 |
| 4,781,323 | 11/1988 | Elias et al. | 229/123.3 |
| 4,792,069 | 12/1988 | Nantin et al. | 222/527 |
| 4,795,065 | 1/1989 | Ashizawa et al. | 222/541 |

FOREIGN PATENT DOCUMENTS

| | | | |
|---|---|---|---|
| 558603 | 6/1958 | Canada | 222/528 |

*Primary Examiner*—Michael S. Huppert
*Attorney, Agent, or Firm*—Lerner, David, Littenberg, Krumholz & Mentlik

[57] ABSTRACT

A pouring spout for a liquid container has a film attached to a pouring hole from inside of the container and a tab tape for covering the pouring hole from outside of the container. The film includes a portion for forming a pouring opening corresponding to the pouring hole, and a lip forming portion along the portion for forming the pouring opening. The tab tape is peelably adhered to the film and a peripheral edge of the pouring hole, the joining portion between the film and the tab tape being inflated outwardly or inwardly of the container. When the tab tape is torn from the container, the lip forming portion is positioned to protrude outwardly.

7 Claims, 2 Drawing Sheets

POURING SPOUT FOR A LIQUID CONTAINER

This is a continuation, of application Ser. No. 07/249,318 filed 9/26/88, now abandoned.

BACKGROUND OF THE INVENTION

(1) FIELD OF THE INVENTION

The present invention relates to a pouring spout attached to a container which stores a liquid therein.

(2) DESCRIPTION OF THE PRIOR ART

For the purposes of reducing manufacturing costs and reducing the weight of a liquid container, paper containers of a gable-top type or the like have been heretofore used. These paper containers have a pouring spout in which a pouring hole is sealed with a film from the inner side of the container, and the pouring hole is covered with a tab tape capable of being peeled off from the outside of the container. This pouring spout is designed so that when the tab tape is pulled up, a slit of a film adhered to the tab tape is cut to open the pouring hole.

In the above-described conventional pouring spout, the peripheral edge of the pouring opening formed by cutting the slit of the film is flat, which involves inconveniences such that a liquid cut-off after the contents have been poured out is poor and the liquid drips over the outer surface of the container.

In view of the foregoing, a problem exists in eliminating the liquid drip when the tab tape is pulled out to pour the liquid.

SUMMARY OF THE INVENTION

The present invention has been achieved in consideration of the aforementioned conventional problem and provides a pouring spout for a liquid container comprising a film attached to a pouring hole from inside of a liquid container, said film having a pouring opening forming portion corresponding to said pouring hole, and a tab tape for covering the pouring hole from outside and being peelably adhered to said film and a peripheral edge of the pouring hole, characterized in that said film is provided on a surface corresponding to the pouring hole with a lip forming portion along the pouring opening forming portion, a joining portion between the film and the tab tape is inflated outwardly or inwardly of the container and when the tab tape is torn off, said lip forming portion is provided so as to be protruded, thus overcoming the above-described problem.

In the present invention, when the tab tape is torn off, the pouring opening is provided in the pouring opening forming portion and the lip forming portion is pulled out, and the pouring lip is protruded from the opened pouring opening.

DESCRIPTION OF THE PREFERRED EMBODIMENTS

Figure 1:
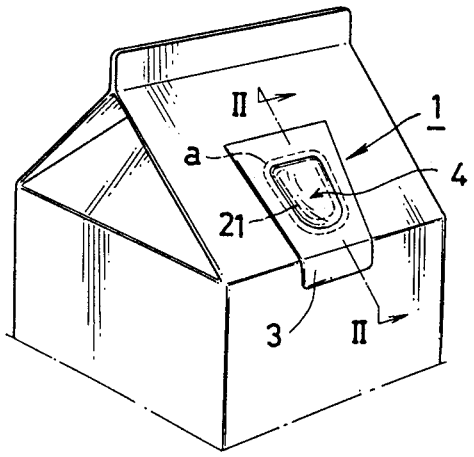
FIG. 1 is an explanatory view showing a container provided with one embodiment of a pouring spout for a liquid container.
Figure 2:
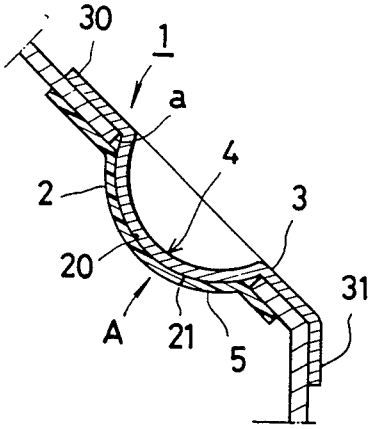
FIG. 2 is a cross-sectional view taken along lines II—II of FIG. 1.
Figure 3:
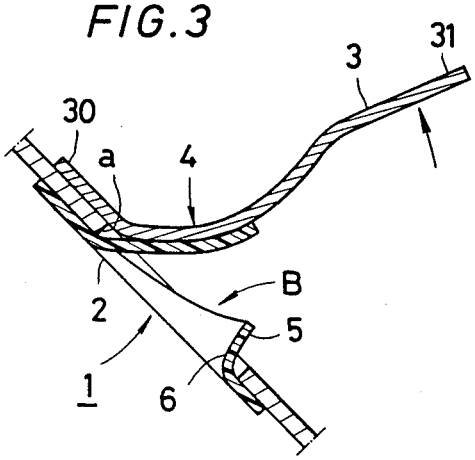
FIG. 3 is a cross-sectional view of one embodiment of a pouring spout in an unsealed condition.

The present invention will now be described in detail by way of embodiments shown in FIGS. 1 to 8.

In the figures, reference numeral 1 designates a pouring spout made of synthetic resin. This pouring spout 1 is attached to a pouring hole a positioned in the upper inclined plane of a container of a gable-top type, for example. The pouring spout 1 consists of a film 2 for sealing the pouring hole a from inside of the container and a tab tape 3 for covering the pouring hole a from outside of the container, and a surface 20 of the film 2 corresponding to the pouring hole a is provided with a pouring opening forming portion A surrounded by a slit 21 substantially in the shape of a U formed in the lower edge side of the pouring hole a (the lower edge side of the upper inclined plane). The tab tape 3 has its upper end 30 (on the side of an upper seal portion of the container) adhered to the container, the upper end 30 being peelably adhered to the peripheral edge of the pouring hole a and the film 2. When the tab tape is upwardly torn off while holding a lower end 31, the slit 21 of the film 2 is ruptured, and a pouring opening B, through which contents (liquids) can be poured with the pouring hole a unsealed, is formed from the pouring opening forming portion A.

In the pouring spout 1, a joining portion 4 between the film 2 and the tab tape 3 is shaped so as to be inflated inwardly of the container by means of a press or the like, and a lip forming portion 5 along the slit 21 of the film 2 is protruded inwardly of the container. When the tab tape 3 is torn off, the lip forming portion 5 is pulled outwardly from inside of the container, and when the slit 21 is cut, an outwardly protruding lip 6 is formed. Since the lip 6 is protruded as described above, the liquid cut-off during pouring the liquid is improved and no liquid drip occurs.

Figure 4:
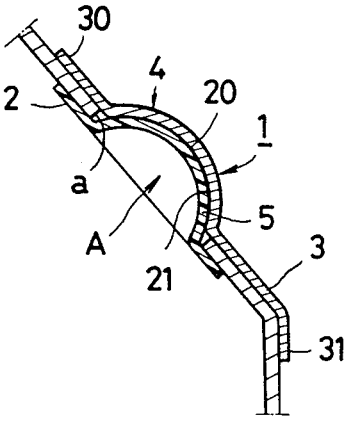
FIG. 4 is an explanatory view showing a further embodiment in cross-section.
Figure 5:
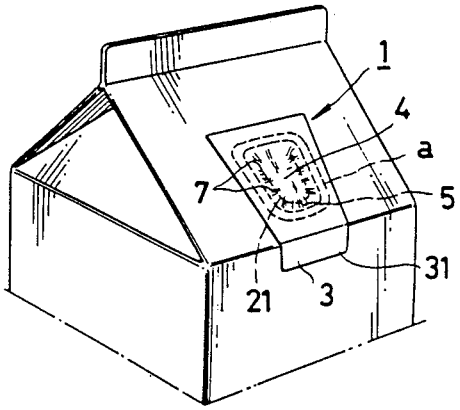
FIG. 5 is an explanatory view showing another embodiment.

The joining portion 4 may be in the form inflated outwardly as shown in FIG. 4, and when the tab tape 3 is torn off and the slit 21 is cut, the lip 6 in the protruded shape is formed. As shown in FIG. 5, the joining portion 4 in the inflated shape may be further pressed to be flattened so as to form draw portions 7. When the tab tape 3 is torn off and the slit 21 is cut, the lip 6 is likewise formed in the protruded shape.

When the tab tape 3 is urged toward the pouring hole after the contents have been poured, the lip and the peripheral edge of the pouring hole are joined and can be resealed, which is hygienic.

Figure 6:
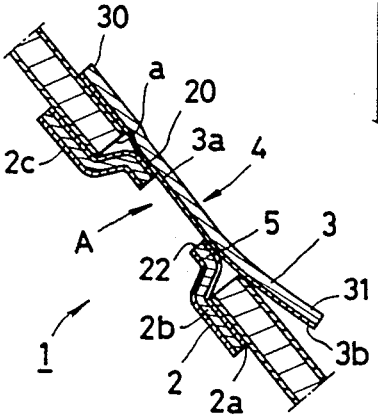
FIG. 6 is an explanatory view of an embodiment in which a film is provided with an open hole.
Figure 8:
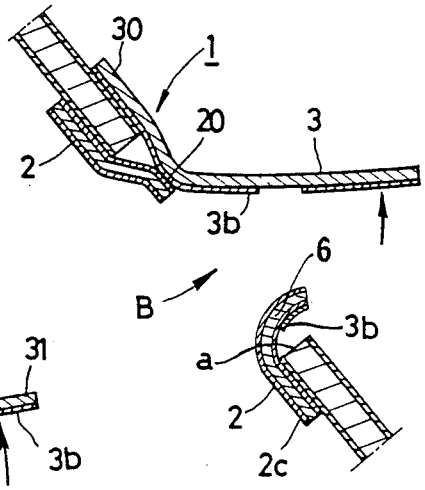
FIGS. 7 and 8 are respectively explanatory views showing the state wherein, in the embodiment in which the film is provided with an open hole, a tab tape is torn off.
Figure 7:
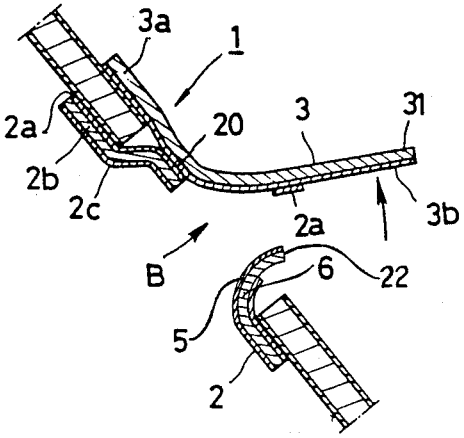

As shown in FIGS. 6 to 8, in the film 2, an open hole 22 corresponding to the pouring hole a is bored in advance whereby a pouring opening forming portion A is provided. The lip forming portion 5 may be provided adjacent to the open hole 22. If the joining portion 4, which has been designed to be inflated, is flattened, when the tab tape 3 is torn off similarly to the above-described embodiment, the lip forming portion 5 is pulled out to form a lip 6. Particularly, FIGS. 6 to 8 show a layer construction. The tab tape 3 is composed of an aluminum foil layer 3*a* and a polyethylene resin layer 3*b*, and the film 2 is composed of a polyethylene resin layer 2*a*, an aluminum foil layer 2*b* and a polyethylene resin layer 2*c*. In the lip forming portion 5, at the time of tearing, the polyethylene resin layer 2*a* in the upper layer of the film may be ruptured and the polyethylene resin layer 3*b* in the lower layer of the tab tape may be ruptured.

As described above, a pouring spout for a liquid container according to the present invention conprises a film attached to a pouring hole from inside of the liquid container, said film having a pouring opening forming portion corresponding to said pouring hole, and a tab tape for covering the pouring hole from outside and being peelably adhered to said film and a peripheral edge of the pouring hole, wherein said film is provided on a surface corresponding to the pouring hole with a lip forming portion along the pouring opening forming portion, a joining portion between the film and the tab tape is inflated outwardly or inwardly of the container and when the tab tape is torn off, said lip forming portion is provided so as to be protruded. Therefore, when the tab tap is torn off, the pouring lip can be provided in a shape protruding outwardly of the container. The liquid cut-off during the pouring of the contents is good, and no liquid drip occurs. Furthermore, in the case where the liquid containers are cartons, if a pouring spout is provided flatly, even if a plurality of cartons are stacked, pouring spouts are not mutually fitted. In addition, when a sleeve is assembled from a carton, if the pouring spout is flat, the sleeve will not be one-side opened and the sleeve can be easily charged into a filling machine. The present invention has many excellent practical effects as just mentioned.

What is claimed is:

1. A pouring spout for a liquid container including a pouring hole comprising, a film attached to said pouring hole from inside of said liquid container, said film having a forming portion for forming a pouring opening corresponding to said pouring hole, and a tab tape for covering the pouring hole from outside of said container, said tab tape being peelably adhered to a peripheral edge of the pouring hole and along a joining portion to said film, characterized in that said film is provided on a surface corresponding to the pouring hole with a lip forming portion along the forming portion, and said joining portion is capable of being inflated inwardly or outwardly of said container so that when the tab tape is torn off, said lip forming portion is provided so as to be protruded outwardly of said pouring opening.

2. A pouring spout for a liquid container according to claim 1 wherein said joining portion between said film and said tab tape is inflated outwardly or inwardly of the container.

3. A pouring spout for a liquid container according to claim 2 wherein said forming portion comprises a slit substantially in the shape of a "U" formed in the film.

4. A pouring spout for a liquid container according to claim 2 wherein said forming portion comprises an open hole made in the film.

5. A pouring spout for a liquid container according to claim 1 wherein said joining portion between said film and said tab tape is pressed into a flat configuration.

6. A pouring spout for a liquid container according to claim 5 wherein said forming portion comprises a slit substantially in the shape of a "U" formed in the film.

7. A pouring spout for a liquid container including a pouring hole comprising, a film attached to said pouring hole from inside of said liquid container, said film having an open hole for forming a pouring opening corresponding to said pouring hole, and a tab tape for covering said pouring hole from outside of said container, said tab tape being pealably adhered to a peripheral edge of the pouring hole and along a joining portion to said film, said film being provided on a surface corresponding to said pouring hole with a lip forming portion along said open hole, said lip forming portion being provided so as to be protruded outwardly of said pouring opening.

* * * * *